United States Patent [19]

Enright et al.

[11] 4,401,959

[45] Aug. 30, 1983

[54] MAGNETICALLY ACTUATED INDICATOR

[75] Inventors: John A. Enright, Orange; Milton N. Ives, Wolcott; Richard H. Daniels, Woodbury, all of Conn.

[73] Assignee: North American Philips Corporation, New York, N.Y.

[21] Appl. No.: 170,362

[22] Filed: Jul. 21, 1980

[51] Int. Cl.[3] ..... H01F 7/08

[52] U.S. Cl. ..... 335/272; 340/815.26

[58] Field of Search ..... 335/272, 258; 340/373, 340/815.26, 815.24

[56] References Cited

U.S. PATENT DOCUMENTS

| | | | |
|---|---|---|---|
| 3,091,725 | 5/1963 | Huston | 335/258 |
| 3,680,083 | 7/1972 | Pihl | 340/373 |
| 4,128,825 | 12/1978 | Madsen | 335/272 |

*Primary Examiner*—Harold Broome

*Attorney, Agent, or Firm*—Robert S. Smith

[57] ABSTRACT

A magnetically actuated indicator which includes an elongated housing and an elongated core having a first asymmetric axial extremity mounted for (a) sliding axial movement and (b) rotation about the axis thereof. At least one elongated winding is disposed for cooperation with the core. The apparatus also includes at least one rotatably mounted indicator member having at least first and second discrete magnetic poles disposed in spaced relationship.

8 Claims, 4 Drawing Figures

MAGNETICALLY ACTUATED INDICATOR

BACKGROUND OF THE INVENTION

The invention relates to indicating devices generally and more particularly to micro-miniature indicators which are capable of visually displaying the presence in a system of either of two conditions, such as favorable or unfavorable.

The prior art includes a wide variety of apparatus of this general type. The apparatus may be categorized in terms of the shape of the indicating element. U.S. Pat. No. 3,671,900 shows a typical cylindrical or round indicating element. The invention has particular application to a ball-shaped indicating element although it will be understood to also have applications to other indicating devices. Ball-shaped indicating elements are shown in U.S. Pat. Nos. 3,872,469; 4,128,825 and 3,487,403. The latter patent illustrates apparatus utilizing two discrete balls which are serially operated to provide a visual indication. The disadvantage of this apparatus is that it is relatively complex and accordingly more expensive and difficult to assemble and manufacture.

The difficulty with assembling the devices in accordance with the invention is particularly acute because of the relatively small size of the apparatus. Such apparatus is ordinarily manufactured to Mil Spec I-83287/3 which specifies a maximum length exclusive of terminals of 1.09 inches. The apparatus in accordance with the invention is ordinarily utilized in an environment in which there is substantial vibration as in airplanes.

It is an object of the invention to provide apparatus which will substantially eliminate indication changes as a result of vibration.

It is another object of the invention to provide apparatus which will avoid mechanical stops which tends to increase the sensitivity of the apparatus to vibration because of the transfer of energy from the stop to the indicating element.

it is another object of the invention to provide apparatus which is simple and as inexpensive as possible to manufacture consistent with the object of preventing accidental change in indication.

SUMMARY OF THE INVENTION

It has been found that these and other objects of the invention may be attained in a magnetically actuated indicator which includes an elongated bobbin; an elongated core having a first asymmetric axial extremity mounted for (a) sliding axial movement and (b) rotation about the axis thereof; at least one elongated winding disposed for cooperation with the core; and at least one rotatably mounted indicator member having at least first and second discrete magnetic poles disposed in spaced relationship. The indicator member cooperates with the core.

The indicator member may be generally spherical and said discrete magnetic poles are disposed proximate to the extremities of a diameter thereof. The spherical member may be mounted with the center thereof disposed in aligned relationship with the axis of the core. The first asymmetric axial extremity of the core may be disposed in oblique relationship to the axis of the core.

The first asymmetric axial extremity of the core may have a generally planar contour which is disposed normally in generally normal relationship to a radius of the spherical member. The core may have a generally circular cross-section except for the first axial extremity.

The apparatus may further include a screw engaging the bobbin and limiting axial movement at the core. The screw may be manufactured of a hard magnetic material.

BRIEF DESCRIPTION OF THE DRAWING

The invention will be better understood by reference to the accompanying drawing in which.

DESCRIPTION OF THE PREFERRED EMBODIMENT

Figure 1:
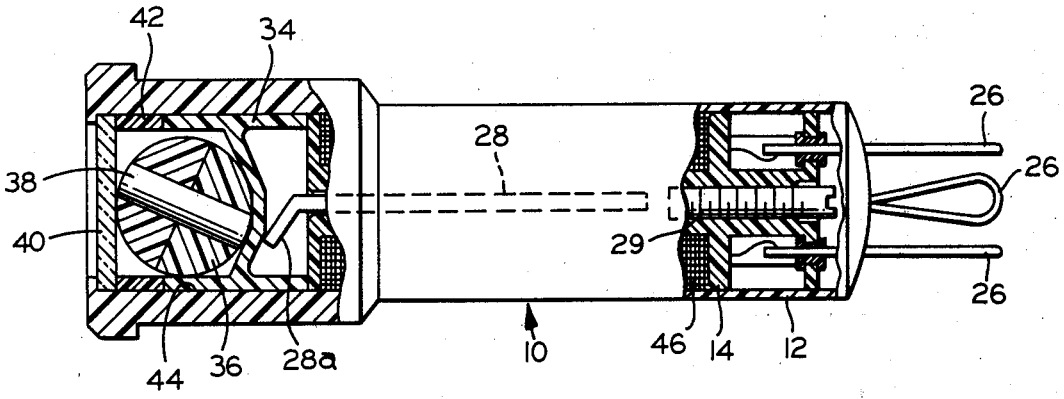
FIG. 1 is an assembly view, in partial section, of the apparatus in accordance with the invention.
Figure 2:
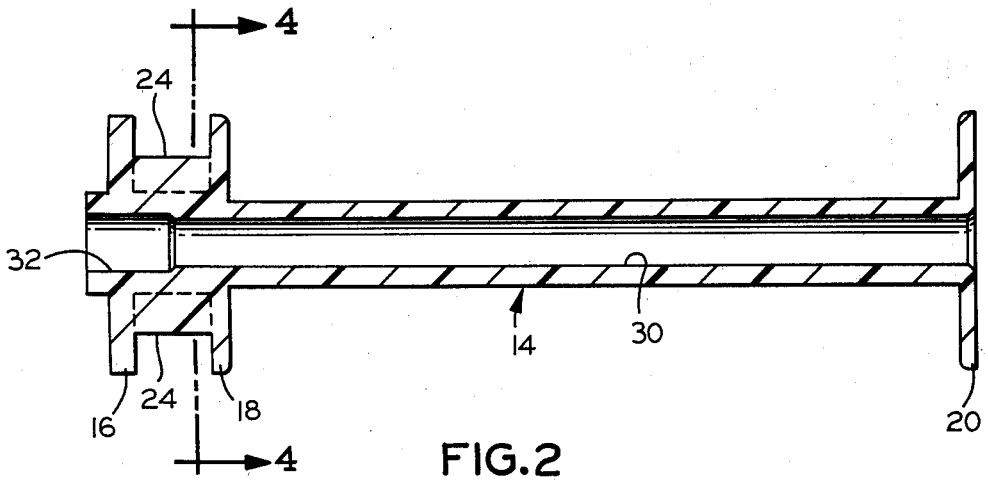
FIG. 2 is a side view of the bobbin which forms a part of the assembly illustrated in FIG. 1.
Figure 4:
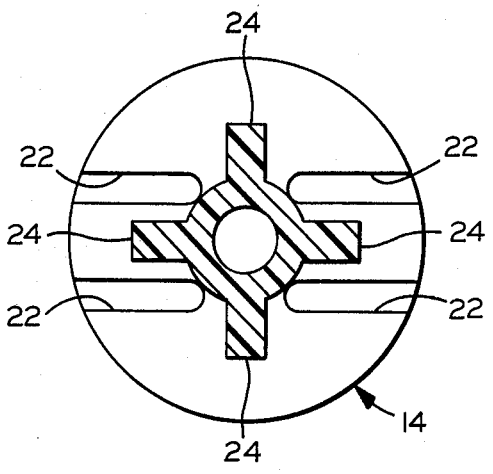
FIG. 4 is a sectional view taken along the line IV—IV of FIG. 2.
Figure 3:
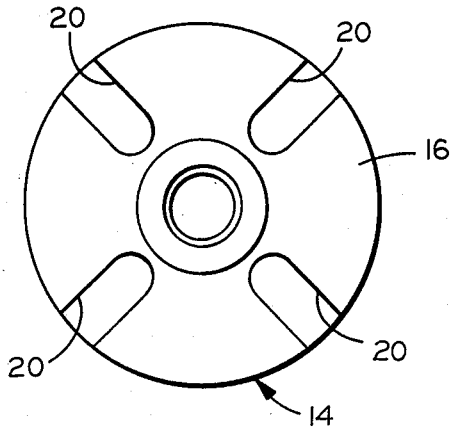
FIG. 3 is an end view of the bobbin illustrated in FIG. 2.

Referring now to FIGS. 1, 2, 3 and 4 there is shown a magnetically actuated indicator 10 which includes a non-magnetic housing 12 in which a bobbin 14 is mounted. The bobbin is best seen in FIGS. 2, 3 and 4 includes generally circular axially spaced flanges 16, 18 and 20 which serve to position the bobbin 14 with respect to the housing 12. The flange 16 is provided with radially extending cut-outs which are disposed at substantially equal angles about the periphery of the flange 16. In a similar manner, cut-outs 22 are provided in the flange 18. The cut-outs 22 are disposed in generally parallel relationship as best seen in FIG. 4. Intermediate the flanges 16, 18, four radially extending ribs 24 are provided. In the complete assembly, at least one coil is wound along the bobbin 14 intermediate the flanges 18, 20 and each lead therefrom extends through on of the slots 22 intermediate the ribs 24 to a slot 20. Ordinarily there will be two discrete windings each having two leads extending therefrom. The windings may be either bifilar (two windings wound simultaneously) or layer wound (each winding being provided in a discrete layer). Each lead extending through one slot 22 and guided intermediate two ribs 24 to a slot 20 is then provided with a suitable termination such as a terminal 26 (3 shown in FIG. 1).

A core 28 having an asymmetrically extending axial extremity **28*a* is disposed within a bore 30 of the bobbin 14. The bore 30 is provided with a counter bore 32 to facilitate assembly of the screw 29 into the bobbin 14. A cup-shaped member 34 is provided for carrying a ball-shaped indicating member 36 which ordinarily will have a hemispherical section having a first color and another hemispherical section having a second color. A permanent magnetic member 38 is disposed within the indicating member 36. The magnet 38** will ordinarily be elongated and disposed in perpendicular relationship to a plane dividing the different colored hemispheres.

For ease of assembly, the glass 40 which allows visual access to the indicating member 36 is initially cemented to a ring-shaped member 42 before being inserted into the bore 44 of the housing 12.

During the assembly the glass 40 with the ring 42 are cemented together and positioned in the housing 12. A winding 46 is placed on the bobbin 14 and suitable terminations provided for the leads extending from the winding 46. The ball indicator 36 is then positioned within the cup 34 and the two are inserted into the housing 12. The core 28 is then inserted into the central bore 30 of the bobbin 14 and both are then inserted into the housing 12. Thereafter, the right side (as viewed) of the assembly is sealed in place with epoxy. In some forms of the invention, a washer (not shown) may be provided in the right side as viewed of the assembly before adding the epoxy.

The core 28 ordinarily will have a slight permanent magnetic characteristic. Ordinarily the material will be a high carbon steel such as 1080 or 1085. Such material is commonly sold as music wire.

In operation, a pulse of electrical power is provided to both terminals 26 which are connected to a single winding 46 on the bobbin 14. This will result in the core 28 moving axially to right as shown and in a polarity of the axial extremity 28*a* which is identical to the polarity of the axial extremity of the magnet 38 which is then nearest to the axial extremity 28*a*. Accordingly, the indicator ball 36 will rotate approximately one-half revolution to the position shown. The ball 36 will stabilize after termination of the electric pulse with the other axial extremity of the magnet 38 proximate to the axial extremity 28*a*. The stabilization will occur because when so aligned the path of least reluctance is established. This path results in the apparatus having a high resistance to vibration. It will be seen that the initial axial movement of the core 28 to the right as shown will tend to "unlatch" the magnet 38 from the axial extremity 28*a* of the core 28. It will be further understood that even if vibration should result in some movement of the ball 36 the geometry of the apparatus will not cause a change in the color which is displayed through the window 40.

The magnet 38 is ordinarily manufactured of a cast Alnico 5 metal. Other moderately coercive magnetic material may also be used. It is desirable that the material have a sufficiently high coerceivity so that stray magnetic fields do not demagnetize the magnet 38. Sintered materials may also be used.

The only ferromagnetic materials in the apparatus in accordance with the invention are the magnet 38, core 28 and screw 29. The magnet 38 is ordinarily a hard magnetic material, that is, one that has high coercive and high residual characteristics. The core 28 and screw 29 ordinarily will be manufactured of a soft magnetic material, that is, they will have a low coercive and low residual characteristics. Screw 29 is provided to limit the axial travel of the core 28. It will be seen that the axis of the core 28 is generally aligned with the geometric center of the ball 36 as well as the center of rotation of the ball 36.

In another form of the invention, the screw 29 may be manufactured of a high coercive material and the apparatus may be operated as essentially a indicator light which cannot burn out. In other words, when electrical power is placed on a winding 46 the ball will rotate to a first position. When electrical power is removed from the winding 46 the ball will be forced to return to a second position due to the magnetic effects produced by the screw 29.

In some forms of the invention a rod-shaped member (not shown) may be substituted for the screw 29. An interference fit between the rod-shaped member and the bobbin 14 will be relied on to hold these elements relative to each other. The apparatus has been found to function reliably and to avoid false triggering responsive to power supply transients.

Having thus described said invention we claim:

1. A magnetically actuated indicator which comprises:

a body member;

a magnetic core having an elongated body having an axis, and a first asymetric axial extremity, means for mounting said core in said body member to allow (a) sliding movement and (b) rotation about the axis of said elongated body thereof;

at least one elongated winding disposed for cooperation with said core; and at least one indicator member having at least first and second discrete magnetic poles disposed in spaced relationship from each other, said member being mounted for magnetic cooperation with said extremity.

2. The apparatus as described in claim 1 wherein said indicator member is generally spherical and said discrete magnetic poles are disposed proximate to the extremities of a diameter thereof.

3. The apparatus as described in claim 2 wherein said spherical member is mounted with the center thereof disposed in aligned relationship with the axis of said core.

4. The apparatus as described in claim 3 wherein said first asymmetric axial extremity of said core is disposed in oblique relationship to the axis of said core.

5. The apparatus as described in claim 4 wherein said first asymmetric axial extremity of said core has a generally planar contour which is disposed normally in generally normal relationship to a radius of said spherical member.

6. The apparatus as described in claim 5 wherein said core has a generally circular cross-section except for said first axial extremity.

7. The apparatus as described in claim 6 wherein said apparatus further includes a screw engaging said bobbin and disposed for limiting axial movement of said core.

8. The apparatus as described in claim 7 wherein said screw is manufactured of a hard magnetic material.

* * * * *